United States Patent [19]

Elsbernd et al.

[11] 4,134,741

[45] Jan. 16, 1979

[54] FOAM CLEANING SYSTEM FOR AN ELECTROSTATIC PRECIPITATOR

[75] Inventors: Carl A. Elsbernd; Wendell P. Spurgin, Cincinnati, Ohio

[73] Assignee: United Air Specialists, Inc., Cincinnati, Ohio

[21] Appl. No.: 837,551

[22] Filed: Sep. 28, 1977

[51] Int. Cl.[2] ..... B03C 3/78; B03C 3/88

[52] U.S. Cl. ..... 55/13; 55/118; 55/120; 134/22 R

[58] Field of Search ..... 55/12, 13, 108, 118–120, 55/242, 431, 110; 134/22 R, 102, 166 R, 171

[56] References Cited

U.S. PATENT DOCUMENTS

| | | | |
|---|---|---|---|
| 1,522,143 | 1/1925 | Rathbun | 55/118 |
| 2,878,892 | 3/1959 | Field | 55/242 |
| 3,037,887 | 6/1962 | Brenner et al. | 134/22 R |
| 3,156,547 | 11/1964 | Fleck | 55/118 |
| 3,615,817 | 10/1971 | Jordan | 134/22 R |

FOREIGN PATENT DOCUMENTS

| | | | |
|---|---|---|---|
| 545367 | 4/1977 | U.S.S.R. | 55/110 |

*Primary Examiner*—Frank W. Lutter
*Assistant Examiner*—David L. Lacey
*Attorney, Agent, or Firm*—Melville, Strasser, Foster & Hoffman

[57] ABSTRACT

The foam cleaning system for an electrostatic precipitator includes a source of a suitable detergent and means for introducing it into a foamer, a source of supply water which is piped through a water pressure reducing valve if necessary and then through a pressure gauge and solenoid valve control and through a suitable filter into the foamer, and a supply of compressed air which passes by suitable conduit through an air pressure regulator and solenoid valve control into the foamer. The detergent, water and air are suitably combined in the foamer and discharged therefrom as a foam into a manifold which will carry the foam to the electrostatic precipitators to be cleaned. The foam is introduced into a space provided at the top of the precipitator above the ionizer and collecting cell plates, between the inlet and outlet filters, and between the side wall of the precipitator. A drain is provided adjacent the precipitator. The top of the precipitator is filled with foam in a relatively short time until it is forced down the various plates in the ionizer and collecting cell at which time the foamer is turned off and the so introduced foam is permitted to penetrate and settle within the precipitator for a somewhat longer period of time. Rinsing water is then introduced into the top of the precipitator and the spent foam, collected contaminants and rinse water are collected in a suitable sump and disposed to a sewer, reservoir or the like. Preferably the rinse water manifold system is separate from the foaming unit.

8 Claims, 8 Drawing Figures

FOAM CLEANING SYSTEM FOR AN ELECTROSTATIC PRECIPITATOR

BACKGROUND OF THE INVENTION

1. Field of the Invention

The foam cleaning system of this invention has particular application to the cleaning of two-stage electrostatic precipitators. A typical precipitator will include an ionizer unit having a plurality of ground plates between which are located ionizing wires. It will also include a collecting cell having support members for a plurality of grounded collecting plates and a plurality of charge collecting plates interleaved among the grounded collecting plates. The ionizer and collecting cell may be combined. In any event the stream of air passing through the precipitator first encounters the ionizer and then the collecting cell. In the practice of the instant invention a filter is provider at the inlet side of the precipitator, i.e., adjacent the exterior side of the ionizer, and another filter is provided at the outlet side of the precipitator, i.e., adjacent the exterior side of the collecting cell. 2. Description of the Prior Art In the past, in some instances, in cleaning electrostatic precipitators, it has been necessary to dismantle the precipitator and to take out the various filters, plates and the like and soak them for an extended period of time or subject them to steam cleaning and the like. In practice the prior art has also cleaned the precipitator in place by using vast quantities of hot water and detergent spray introduced into the precipitator with no penetration time period being provided. The prior art spray, as distinguished from foam, had difficulty in reaching all of the plates and insulator surfaces. This was a serious defect because if contaminants were permitted to form a conductive bridge across any two of the adjoining cell plates within a precipitator module, that module would be rendered inoperative.

Foam generating units of the type employed in the practice of this invention were also known to the prior art; the prior art workers, however, did not know how to incorporate such foam generating units for the cleaning of two-stage electrostatic precipitators, all as will be developed further herein.

Although no search for the prior art has been made, in addition to the systems just mentioned, which are generally used for cleaning precipitators which have relieved air of hydrocarbons, or "wet" contaminants, it is known that some cleaning of electrostatic precipitators can be accomplished by the application of vibrations to the various plates to rid them of "dry" contaminants. With respect to that type of cleaning the following United States Patents are pertinent to some extent: Palmer U.S. Pat. No. 2,490,979; Burton U.S. Pat. No. 2,842,938; Forbes U.S. Pat. No. 1,630,482; and Steuernagel U.S. Pat. No. 3,113,852. Cheney et al. U.S. Pat. No. 4,057,405 entitled "MEANS FOR THE CLEANING AND SELF-CLEANING OF AN ELECTROSTATIC PRECIPITATOR" is also directed to a two-stage electrostatic precipitator in which the plates are rid of a certain amount of dry contaminants by the application of variable frequency vibrations thereto.

In all of the known prior art electrostatic precipitators it has eventually become necessary to subject the unit to a thorough cleaning which goes beyond that accomplished by the various sprays (non-foaming) and vibrating means aforementioned. The instant invention permits such thorough cleaning to take place in situ. It is not necessary to dismantle the precipitators.

SUMMARY OF THE INVENTION

The foam cleaning system for an electrostatic precipitator enables in place cleaning of such precipitators without having to dismantle them. Down time is reduced to a minimum. Foam, initially developed by mechanisms and methods heretofore known, is first subjected to internal restriction and then introduced by novel means and methods into each of the individual electrostatic precipitators and contained therein for a period of time to achieve penetration. This in place cleaning has been made possible by the realization that the foam which exits from the foamer must immediately thereafter be handled in a particular manner before it is introduced into the precipitators. And, when more than one precipitator is employed, the foam must be handled in yet another fashion in order that all of such precipitators will indeed receive a sufficient amount of the foam. These two criteria: one, the generating time and means for handling the foam after it has been created and before it is introduced into each of the electrostatic precipitators; and two, the manner and means for dividing the so held foam just prior to its introduction into the various precipitators, are quite important.

After the foam has been held and handled during a sufficient distance and time period, i.e., after it has been subjected to sufficient internal restriction to permit the formation of durable foam bubbles, and after it has been suitably divided into the required streams, the individual electrostatic precipitator moudles are filled with foam from the top. An upper collecting space for the foam is provided and the pre-filter, after-filter, and walls make up a unit which contains a holding bath comprised of the foam and in which the various plates and insulators are completely submerged. After each precipitator module has been filled with foam and just as the foam is beginning to be forced from the module, i.e., as it begins to ooze through the pre and after filters, thus cleaning them as well, the supply of foam is turned off and the foam thereafter permitted to penetrate and settle, the foam running down the plates and insulators by gravity. The use of the pre-filter and after-filter is also an important part of this development for without such filters there would be insufficient foam holding capacity for the module and, therefore, an inadequate penetration period. Such filters must be about 40% open so as to pass the air from which contaminants are to be precipitated, and yet retain the foam for such penetration period so as to achieve the desired cleaning.

Rinse water is then applied at the top of the various electrostatic precipitator modules and the spent foam, dislodged contaminants and rinse water are all drained from the precipitators into suitable sewers and the like. Typically, it may take about two minutes to fill each electrostatic precipitator module, fifteen minutes for the foam to penetrate and settle, and a short rinse time thereafter to empty the module of all spent foam and collected contaminants. If, for example, a stack of three precipitator modules is employed, the foam generator would be actuated for six minutes before being followed by the dwell or penetration period, and then the rinse.

DESCRIPTION OF THE PREFERRED EMBODIMENTS

Figure 8:
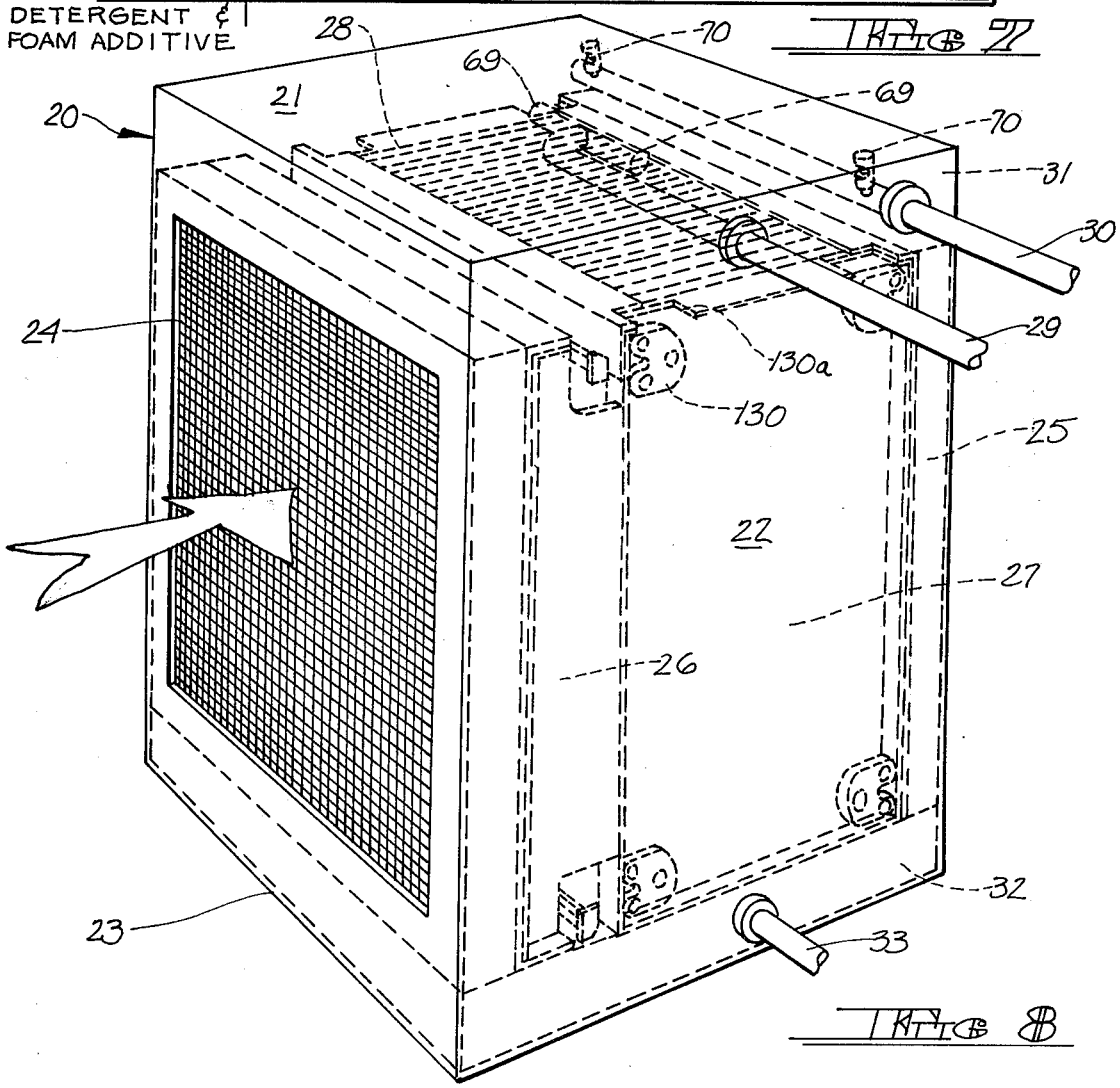
FIG. 8 is a perspective view of an electrostatic precipitator and showing the location of the manifold means for introducing the foam and rinse water thereinto.

Referring first to FIG. 8 there is shown an electrostatic precipitator typical of those to which the instant foam cleaning system may be applied. The arrow indicates the direction in which air to be cleaned by the precipitator flows. The precipitator includes a housing which includes a top wall 21, side walls 22 and a bottom 23. A large portion of the front of the precipitator is comprised of the filter 24 and a large portion of the rear wall of the precipitator is comprised of the filter 25. Within the electrostatic precipitator 20, immediately behind the filter 24 is the ionizer unit 26. The collecting cell 27 is located within the electrostatic precipitator 20 between the ionizer 26 and filter 25. The ionizer 26 and collecting cell 27 include a plurality of plates, some grounded and some charged as is well known to those skilled in the art, and some of which are generally indicated at 28, which plates are parallel to the side walls 22.

The filters 24 and 25, the ionizer 26 and collecting cell 27, and the various plates 28 located within the ionizer and collecting cell, are all so arranged as to leave a space between the tops thereof and the top 21 of the electrostatic precipitator 20. The pipe 29 for introducing foam within the electrostatic precipitator 20 is located within the space just defined and so also is the pipe 30 for introduction of rinse water, or other rinsing solution, into such precipitator. The space into which these pipes 29 and 30 extend is generally indicated by the reference numeral 31. A suitable sump 32 is located adjacent the bottom 23 of the precipitator and it will be understood by those skilled in the art that foam, loosend contaminants and rinse solution will find their way by gravity thereinto and from which sump such materials may exit via the drain 33 to a reservoir, sewer or the like.

Figure 1:
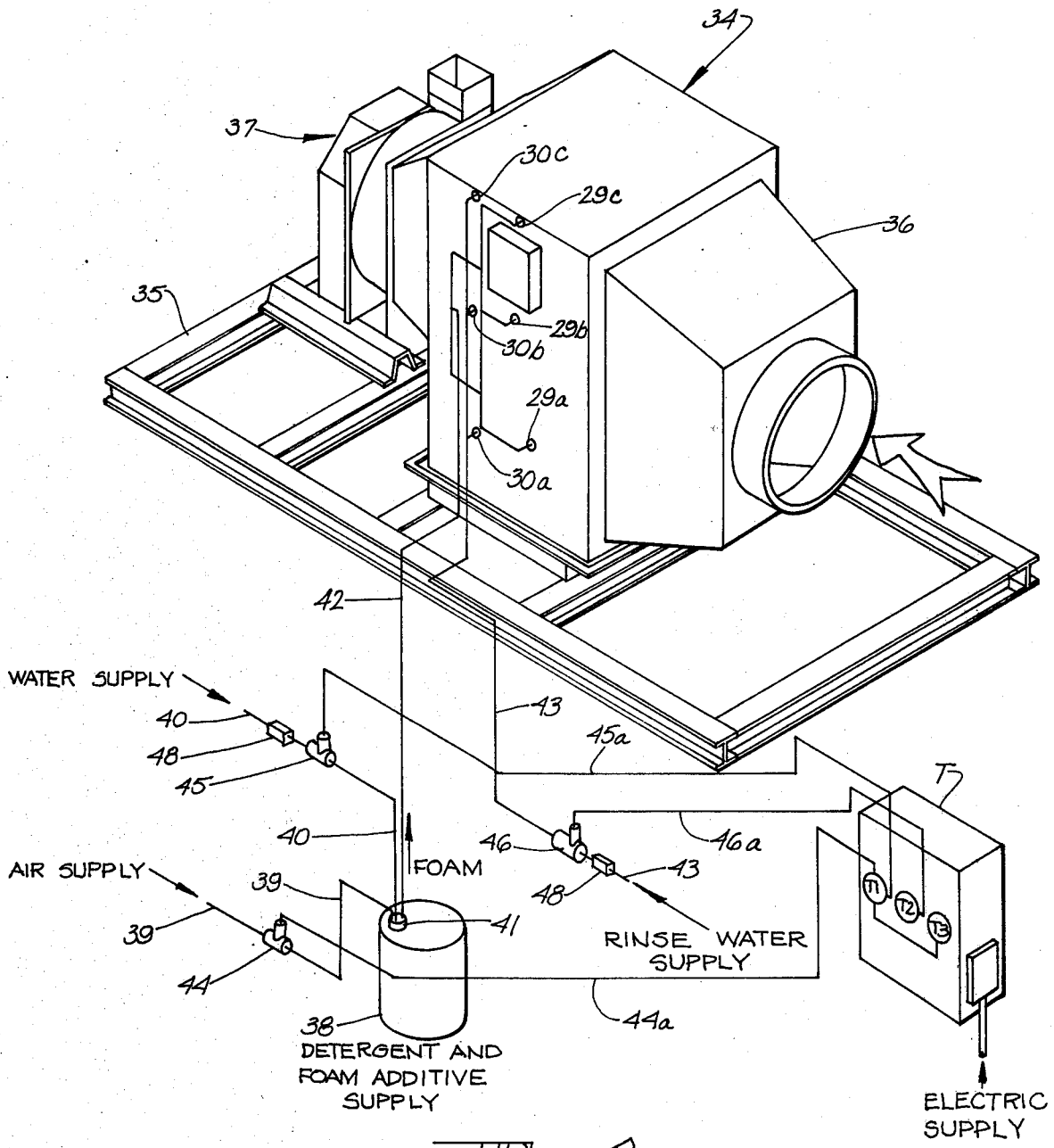
FIG. 1 is a view, partly perspective and partly schematic, disclosing a stack of electrostatic precipitators in an arrangement for the in place cleaning thereof by the application of foam thereto through a suitable manifold arrangement.

Turning now to FIG. 1, the upper part of this figure is a perspective view of an arrangement generally indicated at 34 as comprised of a stack of three electrostatic precipitators of the type described at 20 in connection with the description of FIG. 8. The stack 34 of electrostatic precipitators 20 is mounted on a suitable framework 35 provided for the building. The air being treated moves in the direction indicated by the arrow. Such air is first collected within a plemum 36 after which it is distributed through the stack 34 of three electrostatic precipitators 20. The air being treated is drawn through these precipitators by means of a motor and fan generally indicated at 37. The reference numerals 29*a*, 29*b* and 29*c* schematically represent the foam pipes within the upper spaces of each of the three stacked precipitators, 29*a* being in the top of the lowermost precipitator, pipe 29*b* being in the top of the middle precipitator, and pipe 29*c* being within the top of the uppermost precipitator. Similarly the reference numerals 30*a*, 30*b* and 30*c* schematically indicate the rinse water pipes which are also located within the upper regions of each of the three stacked precipitators.

Figure 7:
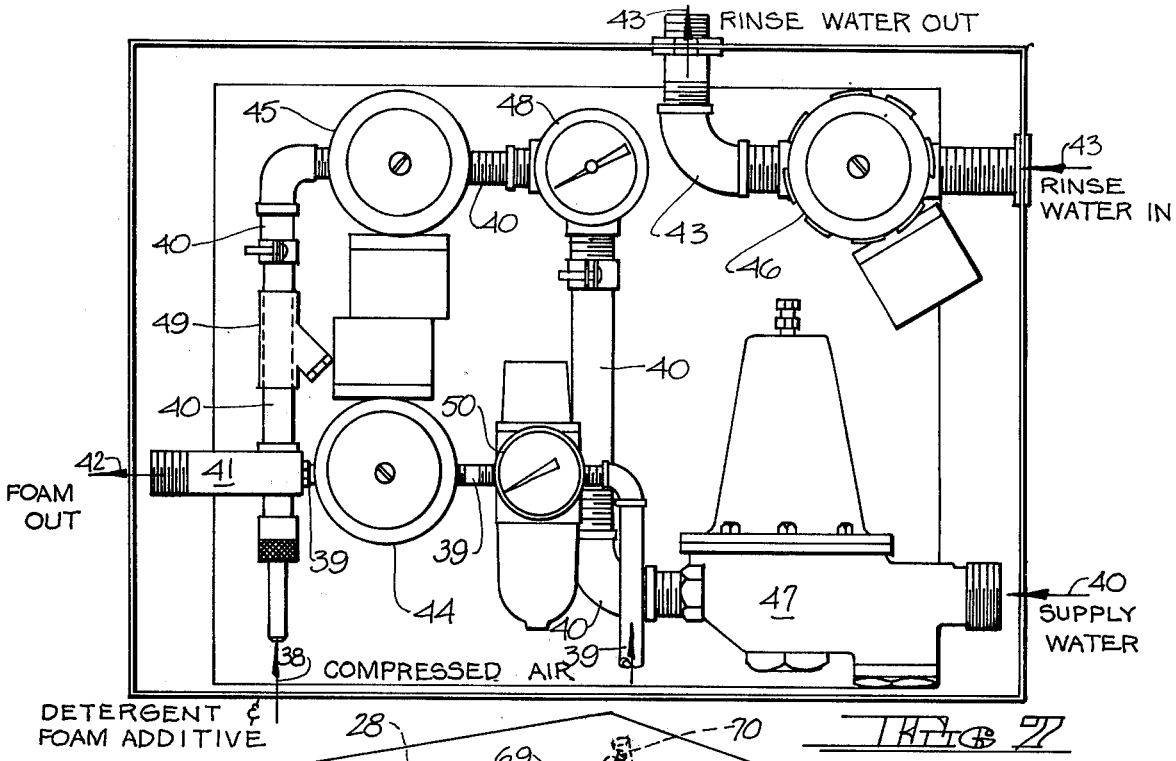
FIG. 7 is an elevational view of the principal apparatus for creating the foam and handling the rinse water.

The lower part of FIG. 1, and FIG. 7, depict in greater detail the location of the means for supplying foam and rinse water to the pipes 29*a*, *b*, *c* and 30, *a*, *b* and *c* respectively.

A source of a suitable detergent is indicated at 38. Air may be introduced into the system through an air hose 39 which may come from any suitable source of compressed air whether it be available generally in the shop or whether it be supplied by a compressor. Water also comes from an available source via the water hose 40. The detergent, air and water are mixed together in the foam generator 41 and the resulting foam advances towards the precipitators via the foam hose 42. Rinse water comes from an available source via the rinse water hose 43 and advances thwards the precipitator via the continuation 43 thereof.

Figure 3:
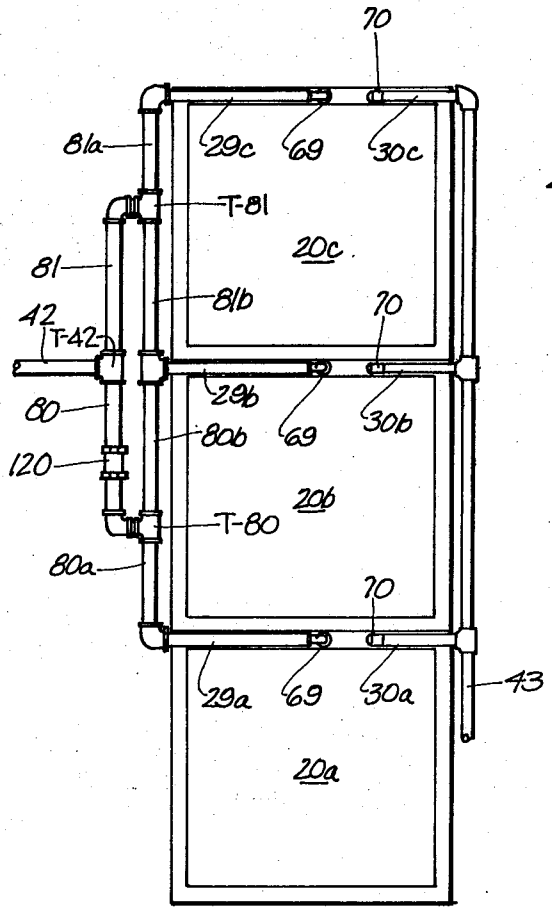
FIG. 3 is a schematic view of the manifold arrangement for the application of foam and rinse water to a stack of three electrostatic precipitators.

The manner in which foam is delivered from the foam generator or foamer 41 via the hose 42 to the foam pipes 29*a*, 29*b* and 29*c* is quite important and is illustrated in greater detail in FIG. 3, which detail will be further explained shortly. FIG. 3 also illustrates the manner in which rinse water is introduced into the precipitators through the pipes 30*a*, 30*b* and 30*c*.

A pair of solenoid valves 44 and 45 control the introduction of air and water respectively to the foam generator or foamer 41 which is so associated with the drum 38 of detergent and foam additive that flow of the air and water mixture through the foamer 41 will draw the detergent and foam additive thereinto. The foam so generated exits via the foam hose 42 towards the precipitator, or stack of precipitators, to be cleaned. It is important that this foam hose be of a fairly long length so as to fully develop the foam characteristics which have been found necessary for proper cleaning of electrostatic precipitators. Such length is on the order of 10 or 12 feet. Even if the drum 38 and foam generator 41 were located within, for example, 2 feet of the stack 34 of electrostatic precipitators, it would still be necessary to employ a flexible hose 42 of the 10 to 12 feet length in order to obtain proper cleaning, even though if one were to cut the hose 42 at a distance of 1 foot from the foamer 41 he would find a mixture of detergent, water and air flowing through the hose 42. This flow, however, as indicated, must continue for the full 10 to 12 feet in order to develop foam of a usable consistency so as to insure optimum, efficient cleaning of the precipitators. This discovery is an important facet of the instant invention.

There is also a rinse water solenoid 46 which controls application of rinse water via the hose 43 to the precipitator or stack of precipitators.

The air solenoid 44, water solenoid 45 and rinse water solenoid 46 are tied into a timer T including three time devices T1, T2 and T3. These time devices are electrically connected with the solenoids 44, 45 and 46 through the wires 44*a*, 45*a* and 46*a* as will be well understood by those knowledgeable with ordinary electric circuitry. The timer T, time devices T1, T2 and T3, solenoids 44, 45 and 46, and wires 44*a*, 45*a* and 46*a* are all so interconnected that the generation and application of foam, the dwell period during which the foam penetrates the ionizer and collecting cell from top to bottom, and the rinse period may be preselected as desired. In a preferred arrangement the solenoids 44 and 45 are actuated so that the foam generator generates and applies foam through the hose 42 into the stack 34 of precipitators via the pipes 29*a*, 29*b* and 29*c* for a period of 6 minutes. The solenoids 44 and 45 are then deactuated and the foam which was charged into the stack of precipitators is permitted to dwell and function therein for a period of 15 minutes. At the end of 21 minutes (6 minutes of foam generation and application, and 15 minutes dwell) the solenoid 46 is actuated for a period of 5 minutes while rinse water is applied through the hose 43 and pipes 30*a*, 30*b* and 30*c*.

With reference to FIG. 7, as well as to FIG. 1, supply water which eventually reaches the foamer 41 via the hose or piping 40 is controlled by means not only of the solenoid 45 but also by the, if needed, water pressure reducing valve 47 (see the right hand side of FIG. 7), the pressure gauge 48, and the filter 49. Compressed air, from whatever source, whether it be from shop air or from an air cylinder and the like, enters the foaming unit via the hose or piping 39 and is controlled not only by the solenoid 44 but also by the air pressure regulator 50. When the solenoids 44 and 45 are actuated, and it is contemplated that they will be actuated together, air and water are introduced into the foamer 41 and detergent and foam additive are drawn from the drum 38 so that a mixture of all, that is, the foam, exits at the left hand side of the unit as viewed in FIG. 7, the foam hose or piping 42 being connected at the left hand end of the foamer 41. When the solenoids 44 and 45 are deactuated, and after the dwell period has passed, actuation of the solenoid 46 will apply rinse water via the hose or piping 43.

Another important discovery which is also a facet of this invention, in addition to that facet involving the discovery that the shortest distance from the foam generator 41 to the stack 34 of precipitators is not necessarily the best, a certain amount of time being needed as accomplished by making sure that the length of hose 42 between the foam generator 41 and precipitator stack 34 is at least on the order of 10 to 12 feet, is the manner in which the stream of foam must be divided. Such stream may readily be divided by two, but not readily by three. The manifold system, therefore, takes this discovery into account. A variety of such systems are depicted in FIGS. 2 through 6 and will now be described.

These FIGURES represent stacks of varying numbers of the electrostatic precipitators 20 shown in FIG. 8. The various stacks 34, therefore, will be shown and described as made up of a number of electrostatic precipitators 20*a*, 20*b*, 20*c* and so forth.

Figure 2:
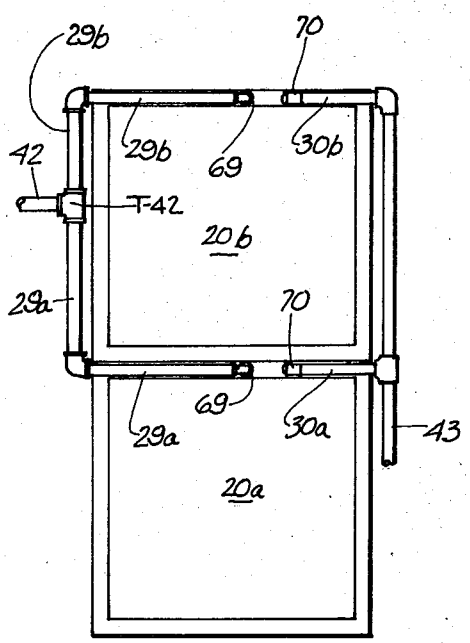
FIG. 2 is a schematic view of the manifold arrangement for the application of cleaning foam and rinse water to a stack of two electrostatic precipitators.

In FIG. 2 the foam hose or piping 42 delivers foam to the conduits (suitable piping or hose as desired) 29*a* and 29*b* for the lower and upper precipitators 20*a* and 20*b* respectively. Rinse water from the hose or piping 43 is delivered to the conduits 30*a* and 30*b* (these may be piping or hose as desired) for the lower and upper precipitators 20*a* and 20*b* respectively. The division of the foam stream from 42 to the conduits 29*a* and 29*b* is readily made since this division of the stream is by two. The conduits 29*a* and 29*b* extend into the upper regions 31 (see FIG. 8) of their respective precipitators, above the various plates located in the ionizer 26 and collecting cell 27. In all instances that piping 29 which eventually terminates within the upper region 31 of an electrostatic precipitator 20 is so arranged that foam is applied at substantially right angles to the various plates 28. Preferably the terminal end of the piping 29 is double ended as indicated at 69 in FIG. 8. It will be understood that the arrangement 29, 69 will exist in the upper regions 31 of all of the electrostatic precipitators 20 whether there is a stack of two of such precipitators or of three or more as desired.

Similarily, the various conduits 30 extending into the upper regions 31 of the respective electrostatic precipitators 20 will have discharge nozzles 70 which will spray rinse water downwardly within the respective precipitators. The arrangement 30, 70 will be the same for all of the precipitators 20 regardless of how many there are in a stack 34. Application of rinse water to the various stacks, regardless of how many precipitators are included in a stack, does not present any particular problem. This is to be distinguished from the problem which does exist in dividing the stream of foam for application to the precipitators as will now be enlarged upon.

In the FIG. 2 arrangement the stream of foam coming through the conduit 42 is divided directly to the conduits 29*a* and 29*b* for application of foam to the respective precipitators 20*a* and 20*b*. The fitting T–42, however, even though only two precipitators are to be supplied, is not necessarily simply located mid-way between the conduits 29*a* and 29*b*; rather, it may be located so as to take the gravity effect into account. Accordingly the fitting T–42 may be located so that conduit 29*b* is shorter than conduit 29*a* so as to offer less resistance and thus insure the flow of equal amounts of the foam into the precipitator modules 20*a* and 20*b*.

In the arrangement of FIG. 3, however, wherein an odd number (three) of modules are to be supplied, allowance must also be made to accomodate not only gravity and the fact that the foam stream may best be divided by increments of two, but also the fact that portions of some of the divided streams will later be combined. Thus, the foam stream at 42 is first divided into two increments as by means of the conduits 80 and 81, conduit 81 preferably being shorter than conduit 80 to compensate for the gravity effect. A conduit 80*a* will direct a portion of the stream from the conduit 80 to the conduit 29*a* for the lowermost precipitator 20*a*. A conduit 81*a* will direct a portion of the foam stream to the conduit 29*c* for the uppermost precipitator 20*c*. The stream of foam flowing through the conduit 80 is divided into two streams, and the stream of foam flowing through the conduit 81 is also divided into two streams, thus satisfying the fact that various divisions of the foam stream must be done by twos. Thus in addition to the conduits 80*a* and 81*a*, the streams issuing from conduits 80 and 81 are also directed to conduits 80*b* and 81*b* in addition to those at 80*a* and 81*a*. The foam streams flowing through conduits 80*b* and 81*b* are combined and discharged into the conduit 29*b* for the middle precipitator 20*b*.

In FIG. 3, therefore, it will be seen that the foam stream at 42 was first divided into two parts as represented by the conduits 80 and 81; the stream at 80 was then also divided into two parts as indicated by the conduits 80*a* and 80*b* while the foam stream in 81 was divided into its two parts as represented by the conduits 81*a* and 81*b*. By properly locating the various conduits 80 through 81*b*, foam streams of equal volume and intensity are secured in the respective terminal discharge conduits 29*a*, 29*b* and 29*c*.

In order to achieve the foam volume division just discussed it is necessary to locate the respective T fittings (T-80, T-81 and so on) so that the conduit to receive foam from a single line only is closer to the T than is the conduit which is to receive foam from two lines. Thus, again with respect to FIG. 3 by way of example, fitting T-80 is closer to conduit 29*a* than it is to conduit 29*b*; that is, conduit 80*a* is shorter than conduit 80*b*. A larger volume of foam will flow through conduit 80*a* to conduit 29*a* because the shorter length of conduit 80*a* offers less resistance. And a lesser volume of foam will flow through conduit 80*b* because its longer length offers more resistance. Similarly fitting T-81 is closer to conduit 29*c* than it is to conduit 29*b*; that is, conduit 81*a* is shorter than conduit 81*b*. Again, therefore, a larger volume of foam will flow through the shorter conduit 81*a* and a lesser volume through the longer conduit 81*b*.

The arrangement of the fittings T-80 and T-81 of FIG. 3 is such that the larger volumes of foam flowing through the shorter conduits 80*a* and 81*a* to conduits 29*a* and 29*c* respectively are substantially equal to one another, and the total of the two lesser volumes of foam flowing through the longer conduits 80*b* and 81*b*, both to conduit 29*b*, is substantially equal to the volume of foam in either conduit 29*a* or 29*c*. In this manner all of the electrostatic precipitator modules 20*a*, *b* and *c* are supplied with substantially equal volumes of foam.

It will be apparent to those skilled in the art that similar divisions may be made for other stacks of precipitator modules depending on their number. This is true of the two fittings T-100 for the lower three modules 20*a*, *b* and *c* of each of the five and six module stacks of FIGS. 5 and 6, and for the two fittings T-110 for the upper three modules 20*d*, *e* and *f* of FIG. 6.

Figure 5:
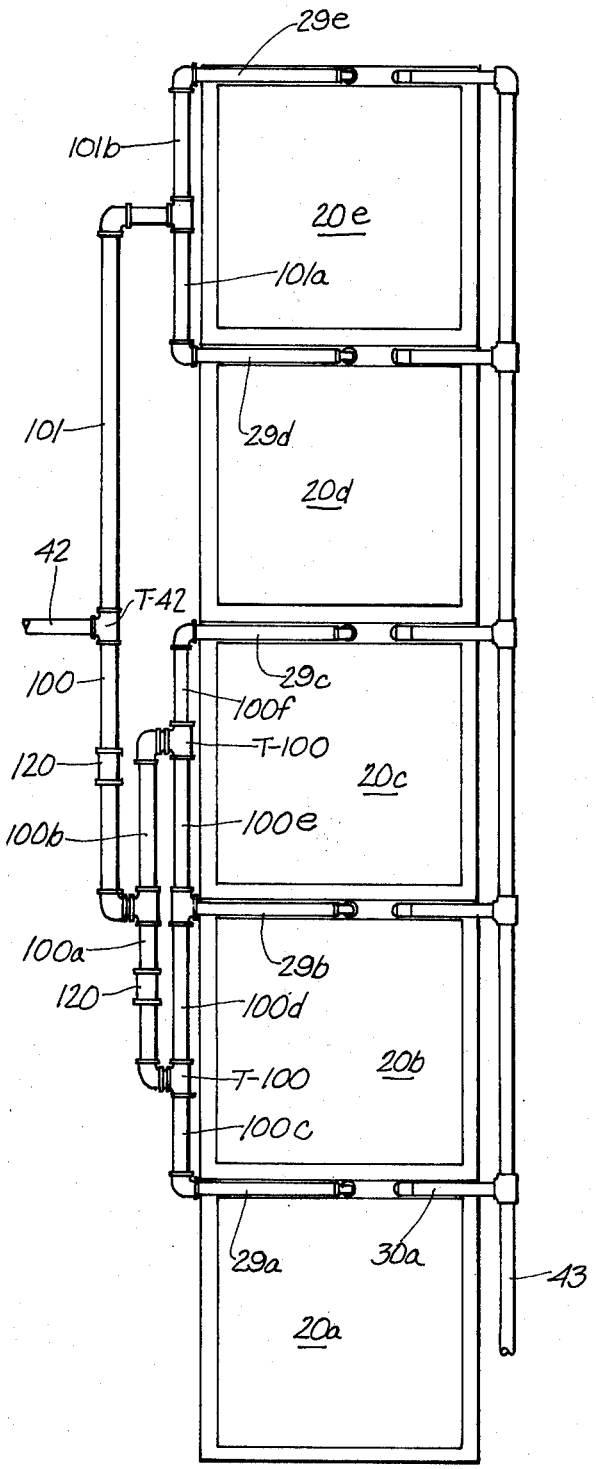
FIG. 5 is a schematic view of the manifold arrangement for the application of foam and rinse water to a stack of five electrostatic precipitators.
Figure 6:
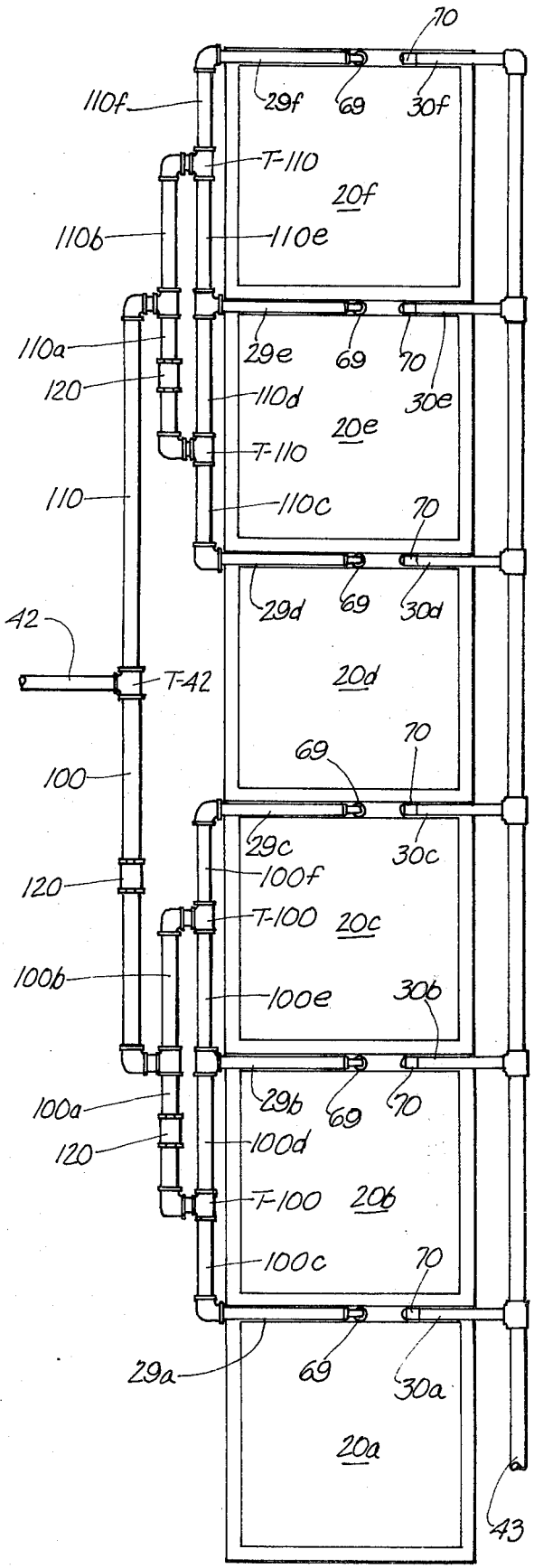
FIG. 6 is a schematic view of the manifold arrangement for the application of foam and rinse water to a stack of six electrostatic precipitators.

Furthermore, when multiple module stacks are being dealt with, particularly such as those of FIGS. 5 and 6, which may be ten or more feet in height, it is even more desirable to adjust the point of initial foam division, such as at T-42, upwards a bit as viewed in FIG. 6 in order to compensate for the effect of gravity and to insure that equal volumes are indeed available for the further divisions which follow as described above. Thus all of the T fittings must be properly balanced to take both the gravity effect into account throughout the system, and the effect of having to first divide some streams into two segments and then later combine some of them, so as to obtain substantially equal volume of foam flow in all of the terminal conduits 29*a*, et seq.

Additionally it is important that the various T fittings by whch the foam stream is divided into two are smooth and uninterrupted so that proper divisions are in fact achieved as governed by the resistances encountered in accordance with the location of such T fittings in their respective conduits, as distinguished from divisions which could result due to irregularities in the T fittings themselves.

Also mention has been made for the need to subject not only the various plates of the two-stage electrostatic precipitator modules to foam cleaning, but also of the need to so clean any internal (within the module) insulators utilized. This is so indicated in FIG. 8 wherein a notch 130*a* has been depicted in the frame structure immediately above the insulator 130 so that foam may run down into direct contact not only with those insulators in line with such notch but also with the outwardmost plates within the module.

Figure 4A:
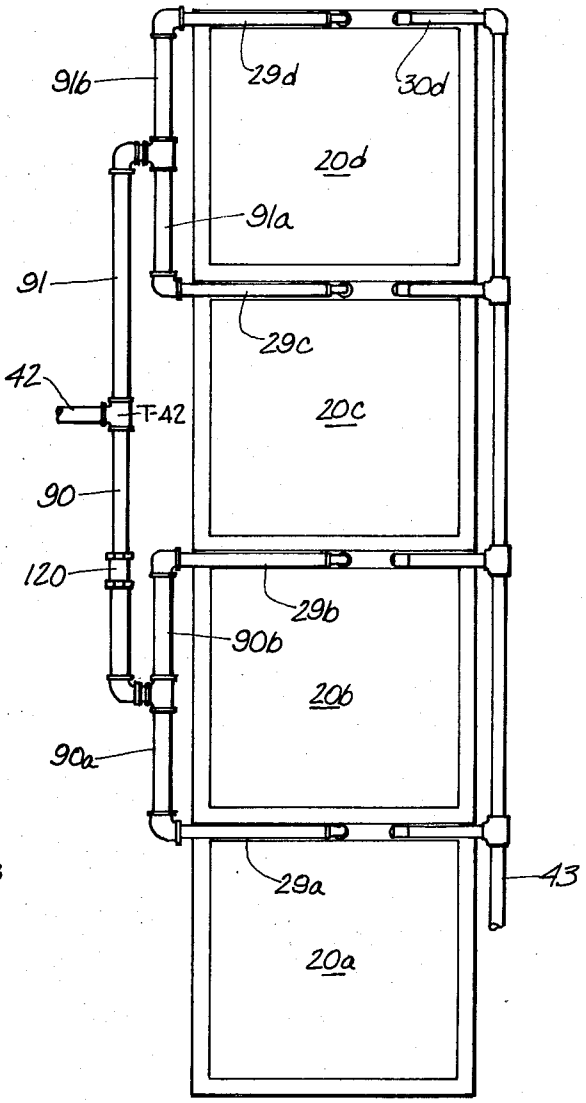
FIG. 4 is a schematic view of the manifold arrangement for application of foam and rinse water to a stack of four electrostatic precipitators.

In the arrangement of FIG. 4 a fourth precipitator has been added as indicated at 20*d*. The manifold arrangement for the foam stream issuing at 42 is, in this instance, in effect simply a doubling of the FIG. 2 arrangement. In this arrangement the foam stream at 42 is first divided into two parts as indicated by the conduits 90 and 91. That part of the foam stream flowing through the conduit 90 is then also divided into two parts 90*a* and 90*b* which feed the conduits 29*a* and 29*b* respectively. Similarily that part of the foam stream which flows through the conduit 91 is also divided into two parts as indicated by the conduits 91*a* and 91*b* which feed the terminal conduits 29*c* and 29*d* respectively.

In FIG. 5 a fifth precipitator 20*e* has been added to the stack 34. In the arrangement of this FIG. 5 the manifold system is, in effect, the combination of the FIG. 3 manifold system for precipitators 20*a*, 20*b* and 20*c* while a FIG. 2 manifold system is employed to accommodate precipitators 20*d* and 20*e*. Again, therefore, the foam stream at 42 is first divided into two parts as indicated at 100 and 101. The foam stream flowing through the conduit 100 is then divided into two parts as indicated at 100*a* and 100*b*. The stream flowing through the conduit 100*a* is then further divided into two parts as represented by the conduits 100*c* and 100*d*. The foam stream in the conduit 100*b* is also further divided into two parts as indicated by the conduits 100*e* and 100*f*. By this manifold arrangement, therefore, the terminal conduit 29*a* recieves its foam from the supply stream 42 via the conduits 100, 100*a* and 100*c*. Terminal conduit 29*b* recieves its foam supply from the foam stream 42 via the conduits 100, 100*a*, 100*d* and conduits 100*b* and 100*e*; conduit 29*b* thus receiving portions of foam stream from conduits 100*d* and 100*e* in the manner just described.

The upper two fifths of the FIG. 5 arrangement includes, as indicated earlier, a manifold arrangement comparable to that employed with the precipitators shown in FIG. 2 Thus the foam stream flowing through the conduit 101 is divided, again into two parts, into streams represented by the conduits 101*a* and 101*b*. Terminal conduit 29*d* within the upper region 31 of the electrostatic precipitator 20*d* is serviced by conduit 101*a* while terminal conduit 29*e* is serviced by conduit 101*b*.

In these various manifold arrangements the spacing of the conduits must be such as to insure that all of the terminal conduits within the respective precipitators receive substantially the same amount of foam stream. Thus, considering the arrangement of FIG. 5, the conduits 100 and 101 must be also located that the amount of foam stream flowing through conduit 100 will be sufficient to provide each of the three precipitators 20*a*, 20*b* and 20*c* with the same amount of foam stream as furnished the precipitators 20*d* and 20*e* via the conduit 101. Similarily, again with respect to FIG. 5, the conduits 100*a* and 100*b* into which the stream flowing from conduit 100 goes, must be such that conduit 100*c* provides terminal conduit 29*a* with all of the foam stream it requires, conduit 100*f* must supply terminal conduit 29*c* with all the foam stream it requires, and the conduits 100*d* and 100*e* must each receive something less than what is suplied to either of the conduits 29*a* and 29*c*, such that the total foam stream supplied terminal conduit 29b by conduits 100d and 100e will be substantially equal to those supplied terminal conduits 29a and 29c.

Finally, FIG. 6 illustrates the manifold system which may be employed with a stack 34 of six electrostatic precipitators. In this arrangement the manifold system is, in effect, a combination of two of those employed in connection with the three stack arrangement of FIG. 3. Another way of putting it is to point that that the lower three precipitators of the stack are arranged the same as are the lower three precipitators of the stack shown in FIG. 5 and, therefore, the same reference numerals will be employed. The manifold arrangement for the upper three precipitators of the stack shown in FIG. 6 will be just like that shown in connection with the lower three stacks and, as noted, may be considered as being like either the arrangement of FIG. 3 or like the arrangement for the lower three stacks of FIG. 5. The upper three precipitators of the FIG. 6 stack are serviced by branch conduit 110 which is first divided into two portions as represented by the conduits 110a and 100b, these latter two conduits then being further divided, each into two additional parts as represented by the conduits 110c and 110d along with conduits 110e and 100f. It will be understood that the stream portion flowing through conduit 100c will supply terminal conduit 29d with all of its foam and that the stream flowing through the conduit 110f will supply terminal conduit 29f with all of the foam it requires. The sum of the stream portions flowing through conduits 110d and 110e will be sufficient to suppy the terminal conduit 29e with an amount of foam substantially equal to that supplied all of the other terminal conduits in the stack.

It should again be observed that the application of rinse water through the various terminal conduits 30a, 30b and so on, as fed via the main supply conduit 43, does not present the problem encountered with the foam supply. Thus the various terminal conduits 30a, 30b and so on are simply connected directly to the supply line 43 without being further divided and subdivided as was needed in connection with the manifold system for the foam stream.

As has been indicated, and as will be well understood by those skilled in the art, the supply sources for air, water and electricity may be those generally available in the areas being serviced by the electrostatic precipitator, or stack thereof. These are all schematically illustrated in the lower part of FIG. 1. It will also be understood, as indicated in FIGS. 2 through 6 that various couplers 120 may be employed in order to easily and readily assemble the various manifold systems to provide the terminal conduits 29a, 29b and so on with their required, substantially equal amounts of foam stream.

Among the important facets of this invention is the discovery that there must be a sufficient amount of conduit 42 between the foam generator 41 and stack 34 of electrostatic precipitators to enable the foam eventually discharged through the various terminal conduits 29a, 29b and so on, all located within the upper regions 31 of the respective electrostatic precipitators 20a, 20b and so on, to get the job done. Thus, for example, if only three feet of conduit 42 were required to reach the stack 34 from the foam generator 41, some arrangement would have to be made to insure that some 10 to 12 feet of conduit 42 were used, not just the three that would reach.

Another important facet of this invention is the discovery that when dividing the foam stream issuing at 42 from the foam generator 41 to supply a plurality of electrostatic precipitators 20, each division of a flowing stream must be into two further segments; if one of these segments is itself to be further divided, such division must also be into two additional segments. The amount of foam stream flowing through these various conduits and subdivisions thereof must then be balanced so that all of the terminal conduits 29a, 29b and so on each receives substantially the same amount of foam stream. In some instances a terminal conduit will be supplied via one final conduit or segment while in other instances the terminal conduit may be supplied by two conduits or divisions thereof. In all instances, however, as just noted, the total amount of foam eventually delivered to each of the terminal conduits will be substantially the same.

A further important facet of the invention is the incorporation of the pre-filter 24 and after-filter 25 with each two-stage electrostatic precipitator module so that such filters pass a desired volume of air through the module for treatment while eventually acting to retain foam during a suitable penetration period for the cleaning of the plates and insulators located within the module.

These concepts of: subjecting the generated foam to a period of internal restriction immediately after it is generated, as may be accomplished by the use of a conduit longer than is actually needed to extend from the foam generator to the point of first foam stream division, and which resulting time delay apparently permits foam bubbles to form and mature without breaking up, whereby to obtain the durable foam bubbles which have been found necessary for efficient cleansing of the two-stage electrostatic precipitator modules; providing means to insure a sufficient penetration period for the foam immediately after each module has been filled with foam, which means are preferably the use of pre-filters and after-filters which are approximately 40% open, as may be accomplished by suitable mesh, screening and the like, whereby the foam is contained within each module for a discernable period before it exits therefrom, as distinguished from a spray (non-foam) directed into a substantially open ended module; and dividing the foam stream always into two parts each time the stream is divided, and in such manner that either a pair of streams of equal volume result from each division, or two pairs of streams eventually result, each pair consisting of a larger volume stream and a lesser volume stream, the two larger volume streams being substantially equal to one another, and the sum total of the two lesser volume streams being substantially equal to either of the larger volume streams; all form a part of this invention.

It is to be understood that it may well be that modifications and improvements may be made in this invention by those skilled in the art without departing from the scope and spirit thereof. It is also to be understood that while the invention has been described in terms of certain particular structures, arrangements and method steps, the invention is not to be limited to such certain particular arrangements, structures and method steps except insofar as they are specifically set forth in the subjoined claims.

The embodiments of the invention in which an exclusive property or privilege is claimed are defined as follows:

1. A multiple stack of two-stage electrostatic precipitator modules, each module being comprised of a housing including top, bottom, and side walls, and an ionizer and collecting cell located within said housing; a pre-filter at the front, receiving end of said housing and through which pre-filter air to be treated passes before first being subjected to the ionizer and then to the collecting cell, and an after-filter at the rear, discharge end of said housing, said pre-filter and said after-filter being sufficiently open to permit air to pass therethrough and sufficiently closed so as to provide, with said top, bottom and side walls, a reservoir for the temporary containment of a bath of foam; each of said housings including an open space above said ionizer and said collecting cell; foaming means to create an initial stream of cleansing foam; first conduit means for conducting said initial stream from said foaming means towards said open spaces; dividing means connected to said first conduit means so as to divide said initial stream of foam into substantially equal segments while allowing for the effect of gravity on such division; said first conduit means being of sufficient length to fully develop the foam characteristics of said initial stream before it reaches said dividing means; and second conduit means extending from said dividing means for discharging said segments into said open spaces so as to temporarily fill each of said housings with baths of foam which are substantially equal; means to introduce a rinse solution into said open spaces; and drain means in each of said housings for the eventual discharge of said foam, rinse solution and any contaminants loosened by said foam and rinse solution.

2. The stack of claim 1 in which there are a pair of said modules; said dividing means including first T-means located so as to divide said initial stream of cleansing foam into two of said substantially equal segments.

3. The stack of claim 2 including a third module, and a second dividing means which includes a second T-means connected to said second conduit means for dividing a said segment therein into two further segments, and a third dividing means which includes a third T-means also connected to said second conduit means for dividing another said segment therein into two further segments, said second and third T-means being so located with respect to said first T-means that the further segments issuing from each of said second and third T-means includes a larger volume segment and a lesser volume segment, said larger volume segments being substantially equal to one another, and further conduits directing each of said large volume segments to respective said open spaces in two of said modules, the sum of said lesser volume segments being substantially equal to one of said larger volume segments, and still further conduits for directing said sum into the said open space of the remaining module.

4. A method of cleaning a multiple stack of two-stage electrostatic precipitator modules which comprises: providing each of said modules with means to permit the passage of air therethrough for treatment, said means also serving to temporarily contain foam introduced into each of said modules; generating an initial stream of cleansing foam; handling said stream so as to fully develop its foam characteristics; then dividing said initial stream of cleansing foam into substantially equal segments of foam while allowing for the effect of gravity on such division; discharging one of said segments of said cleansing foam into the top of each of said modules to fill same with a bath of foam; temporarily holding said bath of foam in each of said modules to permit said foam to loosen any contaminants within said module; discharging rinse solution into the top of each of said modules; and draining said foam, contaminants and rinse solution from all of said modules.

5. The method of claim 4 including the step of subjecting said initial stream to a period of internal restriction prior to dividing said stream and discharging the segments into said modules, said period being longer than that actually needed for conducting said stream from the generating means to said modules.

6. The method of claim 4 as applied to the cleaning of a plurality of said modules including the steps of dividing the said stream of cleansing foam always into two segments each time the said stream is divided, and accomplishing such division in such manner that either one pair of segments of equal volume results from each such division, or two pairs of segments eventually result, each pair consisting of a larger volume stream and a lesser volume stream, the two larger volume streams being substantially equal to one another, and the sum total of the two lesser volume streams being substantially equal to either of the two larger volume streams, and cleaning one module with one of said larger volume streams, cleaning another module with the other of said larger volume streams, and cleaning a third module with the sum total of the two lesser volume streams.

7. A two-stage electrostatic precipitator module, said module being comprised of a housing including top, bottom, and side walls, and an ionizer and collecting cell located within said housing; a pre-filter at the front, receiving end of said housing and through which pre-filter air to be treated passes before first being subjected to the ionizer and then to the collecting cell, and an after-filter at the rear, discharge end of said housing, said pre-filter and said after-filter being sufficiently open to permit air to pass therethrough and sufficiently closed so as to provide, with said top, bottom and side walls, a reservoir for the temporary containment of a bath of foam; said housing including an open space above said ionizer and said collecting cell; foaming means to create an initial stream of cleansing foam; first conduit means for conducting said initial stream from said foaming means to said open space, said first conduit means being of sufficient length to fully develop the foam characteristics of said initial stream while it is being conducted from said foaming means to said open space; and said first conduit means discharging said fully developed initial stream of foam into said open space so as to temporarily fill said housing with a bath of foam; means to introduce a rinse solution into said open space; and drain means in said housing for the eventual discharge of said foam, rinse solution and any contaminants loosened by said foam and rinse solution.

8. A method of cleaning a two-stage electrostatic precipitator module which comprises: providing said module with means to permit the passage of air therethrough for treatment, said means also serving to temporarily contain foam introduced into said module; generating an initial stream of cleansing foam; thereafter handling said initial stream so as to fully develop its foam characteristics; then discharging said fully developed initial stream of foam into the top of said module to fill same with a bath of foam; temporarily holding said bath of foam in said module to permit said foam to loosen any contaminants within said module; discharging rinse solution into the top of said module; and draining said foam, contaminants and rinse solution from said module.

* * * * *